United States Patent [19]

Lersmacher et al.

[11] 4,178,530

[45] Dec. 11, 1979

[54] ELECTRON TUBE WITH PYROLYTIC GRAPHITE HEATING ELEMENT

[75] Inventors: Bernhard Lersmacher, Aachen; Hans Lydtin, Stolberg; Horst Seifert, Hamburg, all of Fed. Rep. of Germany; Johannes W. A. Krol, Eindhoven, Netherlands

[73] Assignee: U.S. Philips Corporation, New York, N.Y.

[21] Appl. No.: 923,495

[22] Filed: Jul. 11, 1978

[30] Foreign Application Priority Data

Jul. 21, 1977 [DE] Fed. Rep. of Germany ..... 2732960

[51] Int. Cl.[2] ..... H01J 1/22; H01J 19/16

[52] U.S. Cl. ..... 313/337; 313/345; 313/346 R; 313/355

[58] Field of Search ..... 313/337, 346 R, 345, 313/355

[56] References Cited

U.S. PATENT DOCUMENTS

| | | | |
|---|---|---|---|
| 3,389,290 | 6/1968 | Yoshida et al. | 313/337 |
| 3,591,822 | 7/1971 | Katz | 313/355 |

*Primary Examiner*—Alfred E. Smith
*Assistant Examiner*—Charles F. Roberts
*Attorney, Agent, or Firm*—Algy Tamoshunas

[57] ABSTRACT

In a thermionic cathode having a planar emissive body and a heating element of pyrolytic graphite which is provided on the side of the emissive body remote from the emissive surface of the emissive body, a uniform temperature distribution adjusts during operation throughout the overall emissive surface when the heating element is planar and the crystallographic c-axis of the pyrolytic graphite extends everywhere normal to the surface of the heating element facing the emissive body. As a result of this the possibility is obtained of realizing a planar, "rapid", induction-free unipotential cathode having a substantially ideal homogeneous temperature distribution.

5 Claims, 8 Drawing Figures

ELECTRON TUBE WITH PYROLYTIC GRAPHITE HEATING ELEMENT

Figure 1:
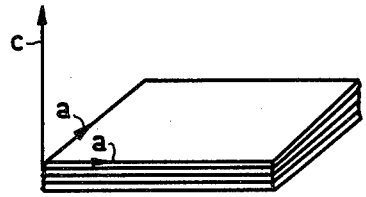

The invention relates to an electron tube comprising a thermionic cathode having a planar emissive body and a heating element of pyrolytic graphite, which is provided on the side of the emissive body remotefrom its emissive surface.

Such electron tubes are, for example, picture tubes, transmitting tubes, cathode ray tubes etc.

Thermionic cathodes used in electron tubes include inter alia dispenser cathodes in which a permanent supply of emissive material is provided from a dispenser chamber or a porous metal body, and layer-shaped cathodes in which an emissive material is incorporated in a coating provided on a base metal. The most important representatives of the layer-shaped cathodes are the oxide cathode and the thorium oxide cathode (Lueger, Lexikon der Technikon, Vol. 13: A. Kuhlenkamp (Ed.) Lexikon der Feinwerktechnik (Stuttgart 1968), p. 493).

In the oxide cathode, a base metal is coated with an alkaline earth oxide layer or a thorium oxide layer. For the various types of tubes, a diversity of shapes of different dimensions is used, for example, circular cathodes, rectangular cathodes, oval cathodes, wire-shaped cathodes and cap-shaped cathodes. The heating of the cathode is effected either by passage of direct current (directly heated cathode) or by means of a separate heating element inserted in sleeves or caps (indirectly heated cathode), which heats the cathode by means of radiation. Sometimes, the cathode is also heated by means of electron bombardment (Lueger, above literature reference, Vol. 14 (1969), pp. 189 and 506).

Thus in directly heated cathodes, the base metal prepared with a material stimulating emission serves as a heat conductor. However, the specific conductivities of substantially all metals to be considered for this purpose are so large, that comparatively long conductors are required so as to reach acceptable resistances and hence acceptable current and voltage values. This means that the heat conductor must be constructed mainly in the form of wire coils. So, on the one hand, there are problems with respect to the space occupied by such wire-shaped heat conductors, while, on the other hand, a heating coil involves physically undesirable side effects. For example a heating coil causes a sometimes undesirably high inductance.

It is known from German Patent Specification No. 2,011,615 that for certain cathode systems pyrolytic graphite is the most suitable material for parts of supports for thermoelectric emitters. Pyrolytic graphite is a synthetic form of carbon which is obtained on a suitable substrate by separation of elementary carbon from a carbon-containing gaseous phase. By previously determining defined separation parameters it is possible to manufacture layers of pyrolytic graphite whose distinguishing characteristic is a pronounced anisotropy of a series of physical properties. A detailed description of the separation process is to be found, for example, in "Carbon" 5 (1967), pp. 205–217 and in "Philips Technische Rundschau" 28 (1967), 143–155.

According to German Patent Specification No. 2,011,615 a thermoelectric emissive tip is held by a part consisting of pyrolytic graphite and serving as a mechanical support for the emissive tip and is referred to in the Patent Specification as a "thermal source". As regards construction, the thermionic cathode described in the Patent Specification corresponds approximately to dispenser cathodes (Lueger, above reference, Vol. 14, p. 581), with the difference that the holders of nickel or molybdenum have been replaced by a holder of pyrolytic graphite. In a preferred embodiment of a thermionic cathode construction according to the Patent Specification, the pyrolytic graphite has a laminated structure in which the layers extend perpendicularly to the direction in which the current flows.

According to German Auslegeschrift No. 1,614,680 thermally highly loaded electrodes or parts of electrodes in electric discharge tubes consist of pyrolytic carbon. The carbon bodies are constructed from several thin discs, and/or annular discs as a result of which, a good thermal conductivity normal to the axis of the tube must be obtained.

German Auslegeschrift No. 1,614,686 discloses an indirectly heated dispenser cathode for electron tubes in which a porous carbon body impregnated with thorium oxide serves as a support for the emissive material. The support for the emissive material is a hollow carbon cylinder closed on one side in which a moulded body of pyrolytic carbon is provided for the direct impact of electrons. In pyrolytic carbon, the plane of the layer must be situated so that an extremely good heat compensation takes place, in particular radially towards the cylinder surface.

Summarizing, the recognition may be derived from the above publications that the pyrolytic graphite bodies used in electron tube technology are always constructed so that the layers of the material extend either perpendicularly to the direction of current flow or normal to the surface of the part of the tube heated or cooled.

In the above-described examples, pyrolytic graphite, despite its anisotropy, is used as a passive heat conducting element. A kind of active function is described in German Auslegeschrift No. 1,615,272 in which, in a resistive heating element, the direction of the high electric resistance parallel to the crystallographic c-axis and simultaneously the preferential heat conductivity at right angles thereto is used.

Although in the thermionic cathode disclosed in German Patent Specification No. 2,011,615 two surfaces of the emissive body extend parallel to the layers of the pyrolytic graphite, it is not the emissive surfaces and hence not the surfaces actually to be heated but only clamping and contact faces that are concerned.

In the thermionic cathodes disclosed in German Patent Specification No. 2,011,615 and German Auslegeschrift No. 1,614,686, pyrolytic graphite is used in the form of blocks. This shape and the preferentially used laminated structure of the pyrolytic graphite result, in all circumstances, in a non-uniform temperature distribution with a decreasing gradient from the emissive material towards the supply conductor.

It is the object of the invention on the contrary to provide an electron tube having a thermionic cathode in which a uniform temperature distribution adjusts during operation over the overall emissive surface.

According to the invention this is achieved in that in an electron tube having a thermionic cathode of the kind described in the preamble, the heating element is planar and the crystallographic c-axis of the pyrolytic graphite extends everywhere normal to the surface of the heating element facing the emissive body.

When the thermionic cathode according to the invention is to be heated directly, it is efficacious to provide the heating element with connections for current passage in a manner such that the current flows preferentially, that is to say with its main component, parallel to the laminated structure of the pyrolytic graphite. The emissive body is preferably provided as a layer on the heating element. Alternatively, the heating element may be provided partly by reactive conversion or by ion implantation with areas of higher electron emission (composite cathode).

The emissive body in an indirectly heated thermionic cathode according to the invention is separated from the heating element by an intermediate space.

Within the scope of the invention, the previously mentioned pyrolytic graphite with pronounced anisotropy is used. In connection with the application according to the invention of this type of pyrolytic graphite as a component of the thermionic cathode, the thermal and electric conductivity and the dependence upon direction thereof are in particular of decisive importance. The value of the thermal conductivity of approximately 0.5 to 1.0 cal/cm sec ° C. in a direction parallel to the laminated structure of the pyrographite separation corresponds to that of the thermal conductivity of readily heat conducting metals, for example aluminium and copper. The electrical conductivity in the same direction, on the contrary, is only approximately 0.2 to $0.5 \cdot 10^4$ ($1/\Omega$ cm) and, hence, is a factor 100 smaller than that of copper.

Layers of pyrolytic graphite have a structure which is substantially free from pores and they are mechanically comparatively stable. They can be easily manufactured in thin layers and also as thin-walled moulded bodies by separation on previously shaped substrates. A material suitable, in principle, for the substrate is any material whose melting or sublimation temperature is higher than the temperature at the substrate surface required for the separation of readily oriented pyrographite. Such materials are, for example, high-melting-point metals, for example, tantalum, tungsten, molybdenum or preferably also polycrystalline electrographite or glassy carbon. The use of electrographite has great advantages in the sense that it can very readily be worked and after the coating process can be easily separated from the pyrographite separation (ready deformability). There are no special difficulties in making bodies of pyrolytic graphite with extremely thin walls in "self-supporting" form by separation on graphite substrates. It is possible, for example, to manufacture hollow cylinders having diameters in the order of magnitude of 1 cm and lengths of 10 cm in wall thicknesses of 100 $\mu$m and less.

The invention presents the advantage that, due to the comparatively low electrical conductivity of such thin-walled moulded bodies of pyrolytic graphite, the heating currents can be kept comparatively small. As a result of the particularly good thermal conductivity parallel to the layers and the low heat capacity of such thin-walled moulded bodies, a very uniform temperature distribution throughout the surface is obtained. In addition this temperature equilibrium adjusts spontaneously. Such a spontaneous heating takes place, for example, within approximately 1 second to 1000° to 1200° C. The uniform temperature distribution can also be obtained in constructions with large surfaces.

A further advantage of the invention is that the bodies can be shaped in a substantially induction-free manner. Immediately after switching on, all places of the indirectly heated cathode are at the same potential.

The use of pyrolytic graphite in accordance with the invention consequently makes it possible to obtain a planar, "rapid", induction-free unipotential cathode having a substantially ideal homogeneous temperature distribution. With respect to mechanical and thermal stability and temperature-dependence, this cathode material is to be preferred over any other material.

Figure 2:
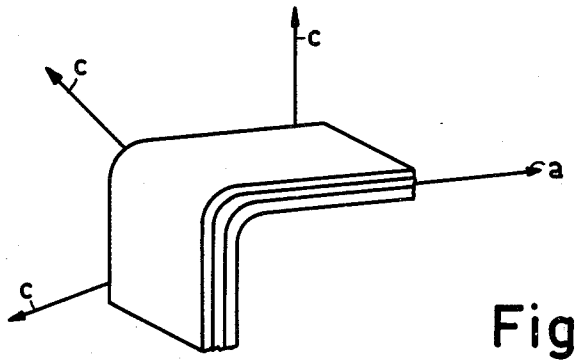
Figure 3:
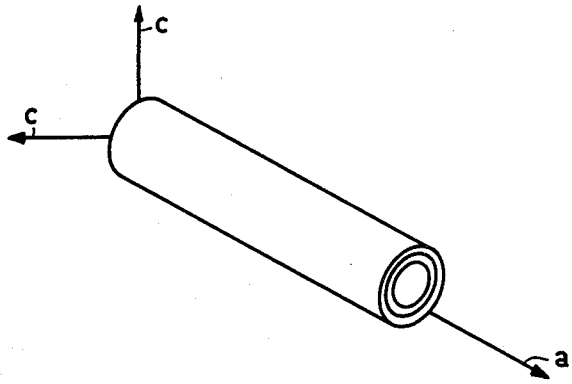
Figure 4:
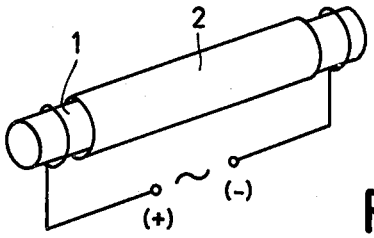

The invention will now be described in greater detail with reference to the accompanying drawing, in which:

FIGS. 1, 2 and 3 show the laminated structure of the pyrolytic graphite is differently shaped heat conductors, and FIGS. 4 to 8 show a few examples of indirectly heated (FIGS. 5 and 6) and directly heated cathodes.

In FIGS. 1, 2 and 3 the variation of the crystallographic axes is denoted by arrows and by the reference symbols a and c.

Figure 5:
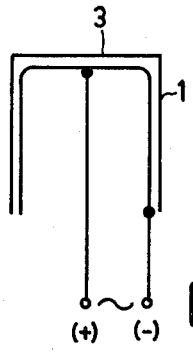
Figure 6:
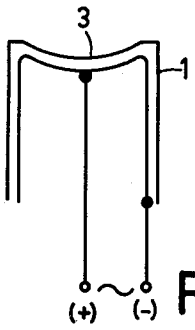
Figure 7:
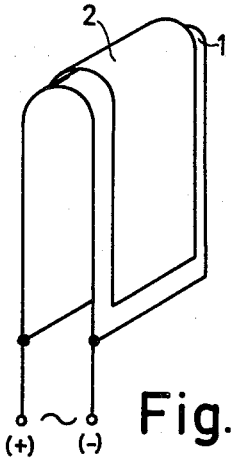
Figure 8:
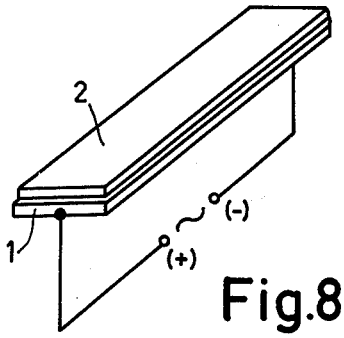

In FIGS. 4 to 8 the heat conductors of pyrolytic graphite are denoted by 1. The parts 2 in FIGS. 4, 7 and 8 denote a coating layer of an emission-stimulating material. The caps 3 in FIGS. 5 and 6 are electron emitters consisting, for example, of a plate of thoriated tungsten.

The coating layer 2 is provided on the heat conductor 1, for example, by sputtering, by vapour-deposition or by reactive deposition from the gaseous phase (CVD-method). If desired, the heat conductor 1 may first be coated with an intermediate layer.

The current supplies are denoted by the symbols (+), (−) and ~.

What is claimed is:

1. An electron tube comprising a thermionic cathode including a planar emissive body having an emissive surface and a heating element of pyrolytic graphite which is provided on the side of the emissive body remote from said emissive surface wherein the heating element is planar and the crystallographic c-axis of the pyrolytic graphite extends everywhere normal to the surface of the heating element facing the emissive body.

2. An electron tube as claimed in claim 1, wherein the heating element of the thermionic cathode is provided with connections for current passage in a manner such that the current flows preferentially with its main component parallel to the laminated structure of the pyrolytic graphite.

3. An electron tube as claimed in claim 1 or 2, wherein the emissive body of the thermionic cathode is provided as a layer on the heating element.

4. An electron tube as claimed in claim 1 or 2, wherein the heating element comprises areas of higher electron emission provided at least partly by reactive conversion or by ion implantation.

5. An electron tube as claimed in claim 1 or 2, wherein the emissive body of the thermionic cathode is separated from the heating element by an intermediate space.

* * * * *